US011143475B1

(12) United States Patent
Childers

(10) Patent No.: US 11,143,475 B1
(45) Date of Patent: Oct. 12, 2021

(54) FIREARM TRIGGER FINGER STOP APPARATUS

(71) Applicant: Joseph Childers, Westport, IN (US)

(72) Inventor: Joseph Childers, Westport, IN (US)

( * ) Notice: Subject to any disclaimer, the term of this patent is extended or adjusted under 35 U.S.C. 154(b) by 0 days.

(21) Appl. No.: 16/996,480

(22) Filed: Aug. 18, 2020

(51) Int. Cl.
*F41A 19/11* (2006.01)
*F41A 19/10* (2006.01)
*F41A 33/00* (2006.01)
*F41A 17/54* (2006.01)

(52) U.S. Cl.
CPC ..... *F41A 19/11* (2013.01); *F41A 17/54* (2013.01); *F41A 19/10* (2013.01); *F41A 33/00* (2013.01)

(58) Field of Classification Search
CPC ..... F41A 17/54; F41A 19/10; F41A 19/11; F41A 33/00
See application file for complete search history.

(56) References Cited

U.S. PATENT DOCUMENTS 2,503,953 A * 4/1950 Lind ..... F41A 17/54 42/70.06
2,598,924 A * 6/1952 Lind ..... F41A 17/54 42/70.06
2,610,425 A * 9/1952 Moore ..... F41A 19/11 42/69.01
2,671,287 A * 3/1954 Hayes ..... F41A 19/09 42/69.01
2,865,127 A * 12/1958 Finnegan ..... F41A 19/11 42/69.01
2,920,413 A * 1/1960 Marhefka ..... F41A 19/09 42/69.01
2,948,978 A * 8/1960 Salverda ..... F41A 17/54 42/70.07
3,031,786 A * 5/1962 Swan ..... F41A 19/11 42/104
4,276,808 A * 7/1981 York ..... F41A 19/09 89/136
4,395,837 A 8/1983 Durnal
4,553,347 A * 11/1985 Jackson ..... F41A 19/09 42/69.01
4,685,379 A * 8/1987 Troncoso ..... F41A 19/09 42/69.01
4,803,910 A * 2/1989 Troncoso ..... F41A 19/09 89/129.02
4,825,576 A * 5/1989 Troncoso ..... F41A 17/54 42/70.07
5,074,190 A * 12/1991 Troncoso ..... F41A 19/16 89/136
5,926,989 A 7/1999 Oliver, Sr.
(Continued)

FOREIGN PATENT DOCUMENTS

WO WO2008088399 7/2008

*Primary Examiner* — Joshua T Semick

(57) ABSTRACT

A firearm trigger finger stop apparatus for training shooters includes a guard clamp body having a guard channel to selectively receive a trigger guard of a firearm. A guard set screw is coupled to the guard clamp body and selectively extends into the guard channel to selectively engage the trigger guard. A stop clamp body is coupled to the guard clamp body. The stop clamp body defines a stop inside. A stop set screw is coupled to the stop clamp body. The stop set screw extends into the stop inside. A finger stop has a stopper portion and an arm portion. The arm portion extends through the stop inside of the stop clamp body and is selectively engaged by the stop set screw.

7 Claims, 5 Drawing Sheets

(56) References Cited

U.S. PATENT DOCUMENTS

| | | | | |
|---|---|---|---|---|
| 6,164,002 | A * | 12/2000 | Troncoso | F41A 19/09 42/69.01 |
| 6,223,644 | B1 * | 5/2001 | Troncoso | F41A 19/09 42/69.01 |
| 6,802,148 | B1 | 10/2004 | Danas | |
| 7,992,338 | B2 | 8/2011 | Bowman | |
| 8,186,087 | B2 * | 5/2012 | Ogershok | F41A 17/54 42/70.06 |
| 9,885,531 | B2 * | 2/2018 | Bair | F41A 19/11 |
| 10,514,221 | B2 | 12/2019 | Richetti | |
| 2007/0006507 | A1 * | 1/2007 | Nehrt | F41A 19/10 42/69.01 |
| 2011/0047849 | A1 | 3/2011 | Brenner | |
| 2013/0288204 | A1 * | 10/2013 | Taylor | F41A 19/10 434/16 |
| 2016/0047617 | A1 * | 2/2016 | DeGidio | F41A 19/08 42/69.01 |
| 2020/0393210 | A1 * | 12/2020 | Aaronson | F41A 19/10 |

* cited by examiner

FIREARM TRIGGER FINGER STOP APPARATUS

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

The disclosure relates to firearm accessory devices and more particularly pertains to a new firearm accessory device for training shooters.

DESCRIPTION OF RELATED ART INCLUDING INFORMATION DISCLOSED UNDER 37 CFR 1.97 AND 1.98

The prior art relates to firearm accessory devices. Known devices for placing a shooter's trigger finger are not adjustable in multiple directions. Such devices may restrict the user's finger front to back finger movement but many do not restrict the depth at which the finger may be placed. Existing devices also may not be clamped on any part of any trigger guard.

BRIEF SUMMARY OF THE INVENTION

An embodiment of the disclosure meets the needs presented above by generally comprising a guard clamp body having a guard channel configured to selectively receive a trigger guard of a firearm. A guard set screw is coupled to the guard clamp body and selectively extends into the guard channel to selectively engage the trigger guard. A stop clamp body is coupled to the guard clamp body. The stop clamp body defines a stop inside. A stop set screw is coupled to the stop clamp body. The stop set screw extends into the stop inside. A finger stop has a stopper portion and an arm portion. The arm portion extends through the stop inside of the stop clamp body and is selectively engaged by the stop set screw.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
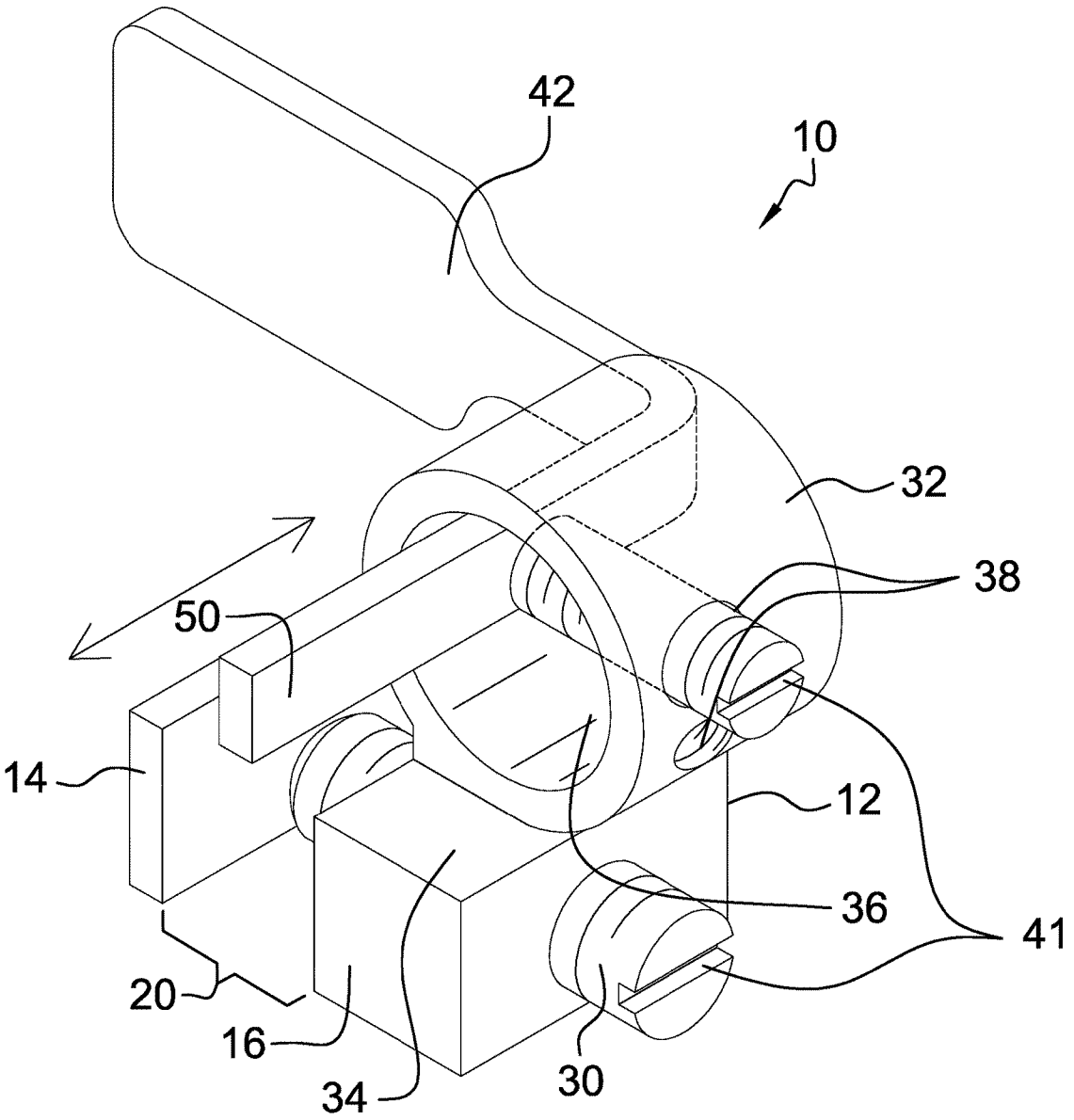
FIG. 1 is an isometric view of a firearm trigger finger stop apparatus according to an embodiment of the disclosure.
Figure 2:
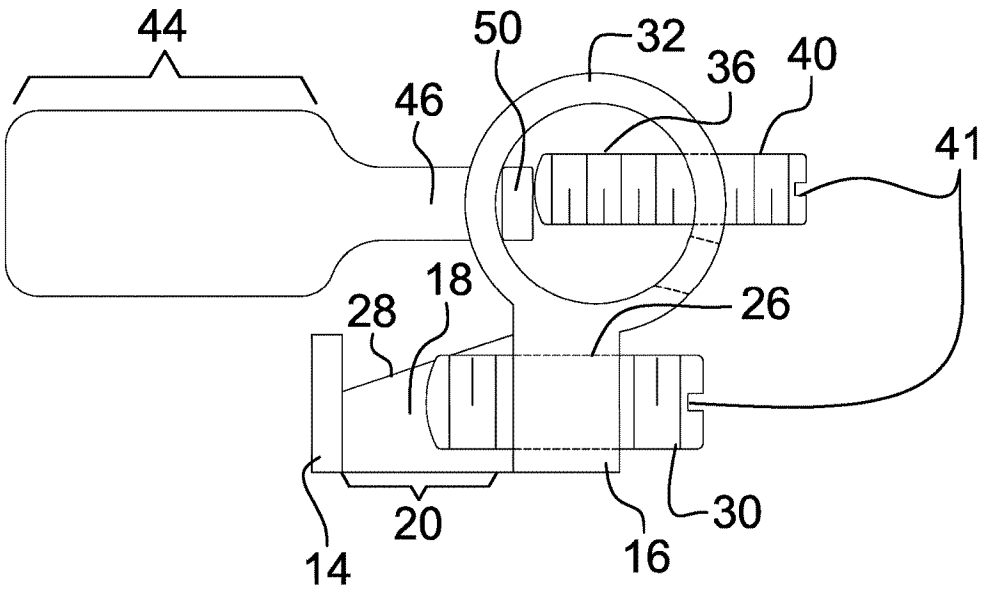
FIG. 2 is a side elevation view of an embodiment of the disclosure.
Figure 3:
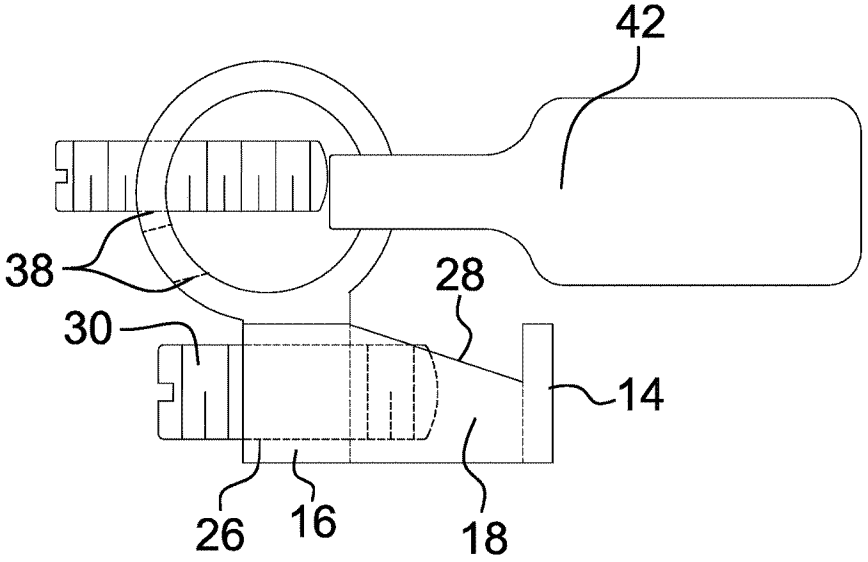
FIG. 3 is a side elevation view of an embodiment of the disclosure.
Figure 5:
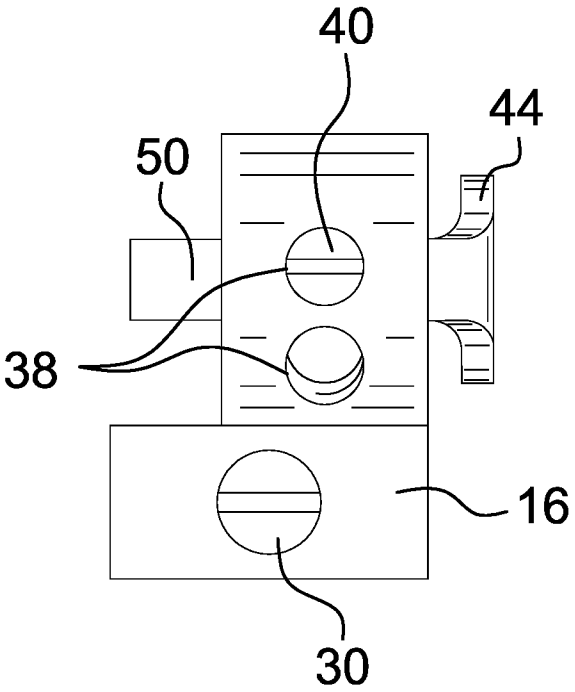
FIG. 5 is a front elevation view of an embodiment of the disclosure.
Figure 4:
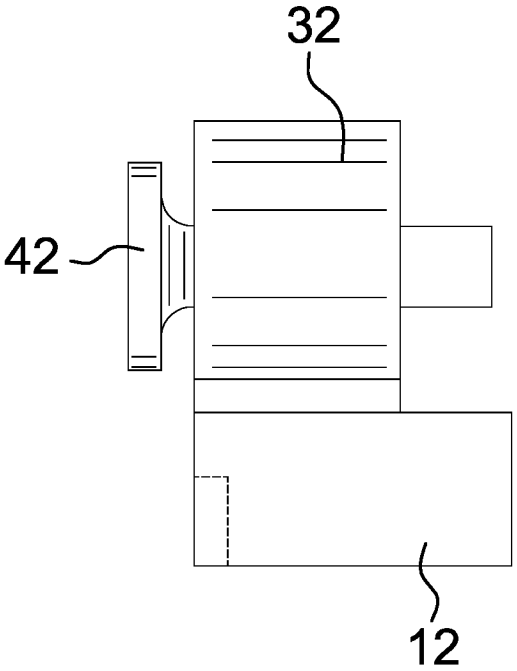
FIG. 4 is a rear elevation view of an embodiment of the disclosure.
Figure 6:
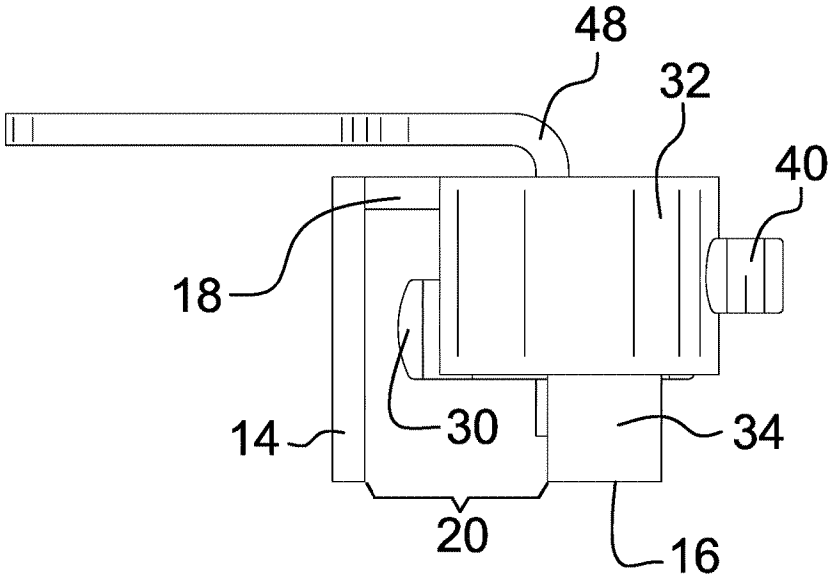
FIG. 6 is a top plan view of an embodiment of the disclosure.
Figure 7:
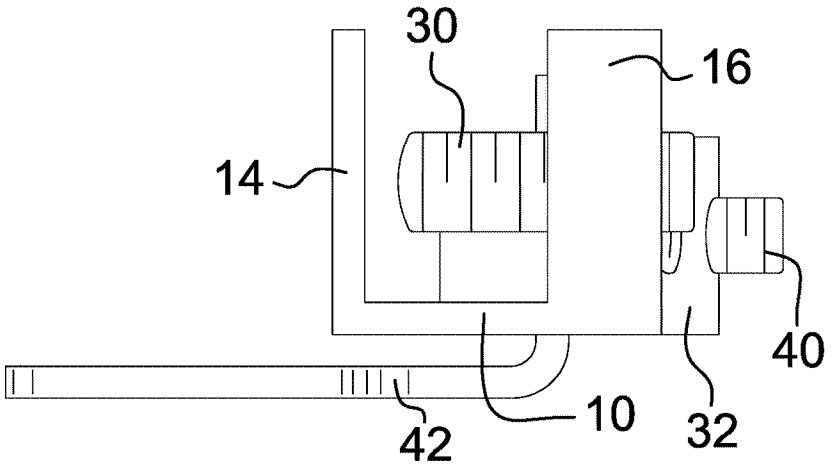
FIG. 7 is a bottom plan view of an embodiment of the disclosure.
Figure 8:
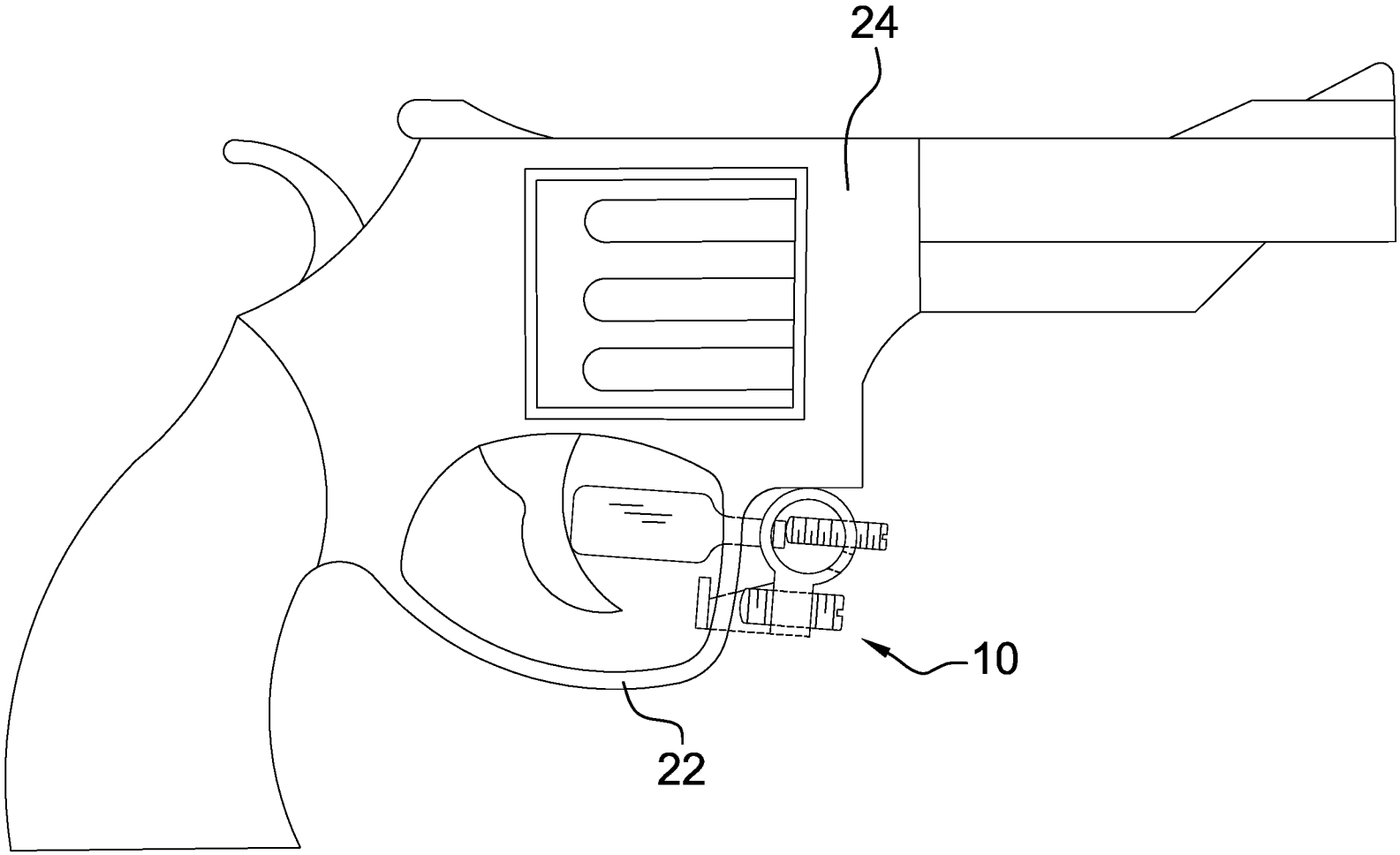
FIG. 8 is an in-use view of an embodiment of the disclosure.

With reference now to the drawings, and in particular to FIGS. 1 through 8 thereof, a new firearm accessory device embodying the principles and concepts of an embodiment of the disclosure and generally designated by the reference numeral 10 will be described.

As best illustrated in FIGS. 1 through 8, the firearm trigger finger stop apparatus 10 generally comprises a guard clamp body 12 having an inner portion 14, an outer portion 16, and a connector portion 18 defining a guard channel 20 configured to selectively receive a trigger guard 22 of a firearm 24. The outer portion 16 has a threaded guard set aperture 26 extending through to the guard channel 20. The connector portion 18 may have an angled upper edge 28.

A guard set screw 30 is coupled to the guard clamp body 12. The guard set screw 30 is selectively engageable with the threaded guard set aperture 26 to selectively extend into the guard channel 20. The guard set screw is configured to selectively engage the trigger guard 22 to secure the apparatus 10 to the firearm 24.

A stop clamp body 32 is coupled to the guard clamp body 12. The stop clamp body 32 is coupled to a top side 34 of the outer portion of the guard clamp body. The stop clamp body 32 is tubular and defines a stop inside 36. The stop clamp body 32 may be positioned on the top side 34 of the outer portion off center to skew away from the guard channel 20 and prevent interference with the trigger guard 22. The stop clamp body 32 has a pair of threaded stop set apertures 38 extending through to the stop inside 36.

A stop set screw 40 is coupled to the stop clamp body 32. The stop set screw 40 is selectively engageable with either of the pair of threaded stop set apertures 38 to extend into the stop inside 36. The user may thus select the angle at which the stop set screw 40 enters the stop inside 36 to create different configurations and positioning of the apparatus 10 on any trigger guard 22. Each of the stop set screw 40 and the guard set screw 30 may have a head slot 41 configured to receive a screwdriver for easy manipulation.

A finger stop 42 has a stopper portion 44 and an arm portion 46. The arm portion 46 of the finger stop may have a 90° elbow 48 and includes a perpendicular section 50 extending perpendicular to the stopper portion 44. The perpendicular section 50 extends through the stop inside 36 of the stop clamp body and is selectively engaged by the stop set screw 40. The stopper portion 44 may be rectangular and has rounded corners.

In use, the guard channel 20 is placed around the trigger guard 22 of the firearm 24 or crossbow. The guard set screw 30 is then tightened to secure the apparatus 10 in place. The finger stop 42 is positioned as desired with the arm portion 46 extending through the stop inside 36 and the stopper portion 44 in a location adjacent a trigger of the firearm 24 that restricts the user's finger and forces perfect finger placement for training purposes and consistency. The stop set screw 40 is then tightened to maintain the finger stop 42 in place before use.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A firearm trigger finger stop apparatus comprising:

a guard clamp body, the guard clamp body having a guard channel configured to selectively receive a trigger guard of a firearm;

a guard set screw coupled to the guard clamp body, the guard set screw selectively extending into the guard channel and being configured to selectively engage the trigger guard;

a stop clamp body coupled to the guard clamp body, the stop clamp body defining a stop inside, the stop clamp body being tubular;

a stop set screw coupled to the stop clamp body, the stop set screw extending into the stop inside; and a finger stop, the finger stop having a stopper portion and an arm portion, the arm portion extending through the stop inside of the stop clamp body and being selectively engaged by the stop set screw.

2. A firearm trigger finger stop apparatus comprising:

a guard clamp body, the guard clamp body having a guard channel configured to selectively receive a trigger guard of a firearm;

a guard set screw coupled to the guard clamp body, the guard set screw selectively extending into the guard channel and being configured to selectively engage the trigger guard;

a stop clamp body coupled to the guard clamp body, the stop clamp body defining a stop inside;

a stop set screw coupled to the stop clamp body, the stop set screw extending into the stop inside;

a finger stop, the finger stop having a stopper portion and an arm portion, the arm portion extending through the stop inside of the stop clamp body and being selectively engaged by the stop set screw; and the arm portion of the finger stop having a 90° elbow and including a perpendicular section extending perpendicular to the stopper portion, the perpendicular section extending through the stop inside.

3. The firearm trigger finger stop apparatus of claim 1 further comprising the guard clamp body having an inner portion, an outer portion, and a connector portion, the outer portion having a threaded guard set aperture extending through to the guard channel; the guard set screw being selectively engageable with the threaded guard set aperture.

4. The firearm trigger finger stop apparatus of claim 3 further comprising the stop clamp body being coupled to a top side of the outer portion of the guard clamp body.

5. The firearm trigger finger stop apparatus of claim 1, further comprising:

the guard clamp body having an inner portion, an outer portion, and a connector portion, defining the guard channel, the outer portion having a threaded guard set aperture extending through to the guard channel;

the guard set screw being selectively engageable with the threaded guard set aperture;

the stop clamp body being coupled to a top side of the outer portion of the guard clamp body, the stop clamp body having a pair of threaded stop set apertures extending through to the stop inside;

the stop set screw being selectively engageable with either of the pair of threaded stop set apertures to extend into the stop inside; and the arm portion of the finger stop having a 90° elbow and including a perpendicular section extending perpendicular to the stopper portion, the perpendicular section extending through the stop inside of the stop clamp body and being selectively engaged by the stop set screw, the stopper portion being rectangular and having rounded corners.

6. The firearm trigger finger stop apparatus of claim 2 further comprising the stopper portion being rectangular and having rounded corners.

7. A firearm trigger finger stop apparatus comprising:

a guard clamp body, the guard clamp body having a guard channel configured to selectively receive a trigger guard of a firearm;

a guard set screw coupled to the guard clamp body, the guard set screw selectively extending into the guard channel and being configured to selectively engage the trigger guard;

a stop clamp body coupled to the guard clamp body, the stop clamp body defining a stop inside;

a stop set screw coupled to the stop clamp body, the stop set screw extending into the stop inside;

a finger stop, the finger stop having a stopper portion and an arm portion, the arm portion extending through the stop inside of the stop clamp body and being selectively engaged by the stop set screw; and the stop clamp body having a pair of threaded stop set apertures extending through to the stop inside, the stop set screw being selectively engageable with either of the pair of threaded stop set apertures.

* * * * *